US006558226B1

(12) United States Patent
Takada et al.

(10) Patent No.: US 6,558,226 B1
(45) Date of Patent: May 6, 2003

(54) POLISHING APPARATUS

(75) Inventors: Nobuyuki Takada, Kanagawa-ken (JP); Tetsuji Togawa, Kanagawa-ken (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/643,882

(22) Filed: Aug. 23, 2000

(30) Foreign Application Priority Data

Aug. 24, 1999 (JP) ..... 11-236765

(51) Int. Cl.[7] ..... B24B 5/00

(52) U.S. Cl. ..... 451/5; 451/285; 451/288; 690/60

(58) Field of Search ..... 451/5, 57, 63, 451/41, 42, 285–289, 392–394, 270, 287, 343, 443, 444; 269/60

(56) References Cited

U.S. PATENT DOCUMENTS 3,609,922 A * 10/1971 Schnizler et al. ..... 451/270
4,023,441 A * 5/1977 Osterwalder ..... 475/176
4,141,180 A * 2/1979 Gill et al. ..... 451/276
4,524,644 A * 6/1985 Pierrat ..... 475/168
5,655,954 A * 8/1997 Oishi et al. ..... 134/62
5,827,110 A * 10/1998 Yajima et al. ..... 451/288
5,830,045 A * 11/1998 Togawa et al. ..... 451/288
5,879,225 A * 3/1999 Kudo et al. ..... 451/271
6,095,904 A * 8/2000 Breivogel et al. ..... 451/173

* cited by examiner

*Primary Examiner*—Joseph J. Hail, III
*Assistant Examiner*—Anthony Ojini
(74) *Attorney, Agent, or Firm*—Wenderoth, Lind & Ponack, L.L.P.

(57) ABSTRACT

There is disclosed a polishing apparatus comprising: a polishing table having a first axis and a counterweight provided on the polishing table. The polishing table is adapted to be subjected to a circular orbital motion in which the first axis of the polishing table is rotated about an orbit center axis while the orientation of the polishing table is kept substantially constant. The counterweight cancels a centrifugal force generated by the circular orbital motion of the polishing table.

11 Claims, 6 Drawing Sheets

PRIOR ART

POLISHING APPARATUS

BACKGROUND OF THE INVENTION

The present invention relates to a polishing apparatus for polishing a workpiece, such as a semiconductor wafer, so as to enable the workpiece to have a flat and mirror-finished surface.

With recent rapid progress in technology for fabricating high-integration semiconductor devices, circuit wiring patterns have been becoming increasingly fine and, as a result, spaces between wiring patterns have also been decreasing. As wiring spacing decreases to less than 0.5 microns, the depth of focus in circuit pattern formation in photolithography or the like becomes shallower. Accordingly, surfaces of semiconductor wafers on which circuit pattern images are to be formed by a stepper are required to be polished by a polishing apparatus to an exceptionally high degree of surface flatness. To accomplish such a high degree of surface flatness, it has become common to use a polishing apparatus known as "CMP" or "Chemical Mechanical Polisher".

FIG. 9 shows a main part of an example of a conventional polishing apparatus for CMP. This apparatus comprises a rotatable polishing table (turntable) 122 having a polishing cloth 120 adhered to an upper surface thereof. The polishing apparatus also comprises a wafer holder 124 for holding a substrate W to be polished, such as a semiconductor wafer, and an abrasive liquid supply nozzle 126 for supplying an abrasive liquid Q to the polishing cloth 120. The wafer holder 124 is adapted to rotate and press the substrate W against the turntable 122. The wafer holder 124 is connected to a drive shaft 128. The drive shaft 128 is supported by a wafer holder head (not shown) through a pneumatic cylinder so as to be vertically movable.

In this polishing apparatus, the substrate W is held on an elastic mat 130 provided on a lower side of the wafer holder 124 and is pressed against the polishing cloth 120 on the turntable 122. While the substrate W is pressed against the polishing cloth 120, the turntable 122 and the wafer holder 124 are rotated, to thereby effect relative movement between the polishing cloth 120 and the substrate W. During this movement, the abrasive liquid Q is supplied from the abrasive liquid supply nozzle 126 onto the polishing cloth 120. As the polishing liquid Q, for example, use is made of a suspension obtained by suspending fine abrasive particles in an alkali solution. Thus, polishing of the substrate W is conducted by utilizing the effect of chemical polishing using alkali and the effect of mechanical polishing using abrasive particles.

In the above-mentioned polishing apparatus, polishing is conducted by rotating the polishing table 122 about an axis thereof, so that polishing cannot be conducted at the center of rotation where no displacement occurs between the polishing cloth 120 and the substrate W. Therefore, in order to conduct polishing at a position spaced apart from the center of rotation, the size of the polishing table 122 is determined so as to have a diameter which is at least twice the diameter of the substrate. Thus, the polishing table 122 is caused to have a large area, with the result that the polishing apparatus also becomes large and requires costly equipment. This becomes a serious problem with a tendency towards the size of the substrate increasing.

As a countermeasure, it is considered to employ, instead of or in combination with the above-mentioned polishing apparatus, a polishing apparatus in which a polishing table is subjected to a circular orbital motion. In this apparatus, any point on a polishing surface of the polishing table is subjected to the same motion. Therefore, the polishing table is required to have a diameter which is only at least a total of the diameter of the substrate and a value twice the radius of the orbit. That is, the size of the polishing table can be substantially equal to the size of the substrate.

However, in the above-mentioned polishing apparatus, the polishing cloth readily deforms during polishing due to elasticity thereof and enters a space between the projecting portions of the substrate W, so that polishing is conducted with respect to not only the projecting portions, but also the recessed portions therebetween. This leads to undulation of a polished surface of the substrate or difficulty in grinding of the projecting portions of the substrate. As a countermeasure, for example, it has been proposed to conduct polishing by a method using an abrasive plate, which is obtained by binding abrasives such as silica particles with the use of a binder and which is adhered to the polishing table. In this method, polishing is conducted by slidably moving the substrate W held by the wafer holder 124 while pressing the substrate W against the abrasive plate. In this arrangement, during sliding movement of the substrate relative to the abrasive plate, the binder is broken down or melted, to thereby release the abrasive particles. Polishing is conducted by the action of these released particles.

In the above polishing method, the abrasive plate is harder than the polishing cloth, so that the substrate can be polished without undulation occurring. Further, polishing is conducted by using only free particles from the abrasive platte, without using a slurry type abrasive liquid containing a large amount of abrasive particles. Therefore, the amount of abrasive particles used can be reduced, leading to a reduction in the cost of operation and ease of maintenance.

For conducting the above-mentioned circular orbital motion of the polishing table, it is considered to displace the center (center of gravity) of the polishing table from the center axis of the drive shaft and connect the polishing table to an upper end of the drive shaft at the center of the polishing table. In this case, in accordance with the circular orbital motion of the polishing table, a centrifugal force is generated in proportion to the distance between the center axis of the drive shaft and the center of the polishing table, and acts on the polishing table. This causes vibration of the drive shaft. In order to prevent such a vibration of the drive shaft, a counterweight having a center of gravity at a position spaced apart from the center axis of the drive shaft is attached to a predetermined position on the drive shaft, to thereby cancel the centrifugal force acting on the drive shaft.

When the position in an axial (heightwise) direction of the center of gravity of the polishing table and the position in an axial (heightwise) direction of the counterweight are different, a rotational moment is generated and acts on the drive shaft. To cancel the rotational moment, an additional counterweight is provided at different axial position on the drive shaft. However, this leads to an increase in length of the drive shaft and thus in size of the polishing apparatus.

SUMMARY OF THE INVENTION

In view of the above, the present invention has been made. It is an object of the present invention to provide a polishing apparatus which can be made compact without impairing the circular orbital motion of the polishing table.

According to one aspect of the present invention, there is provided a polishing apparatus comprising a polishing table having a first axis, the polishing table being adapted to be subjected to a circular orbital motion in which the first axis of the polishing table is rotated about an orbit center axis while the orientation of the polishing table is kept substantially constant, and a counterweight provided on the polishing table for cancellation of a centrifugal force generated by the circular orbital motion of the polishing table. In this apparatus, vibrations imparted to the drive shaft due to the centrifugal force will be able to be suppressed. Further, in this apparatus, there is no need to attach the counterweight directly to the drive shaft and, therefore, the counterweight can be provided at a position (or height) axially close to the polishing table, to thereby reduce the length of the drive shaft and hence, the size of the apparatus.

In accordance with another aspect of the present invention, there is provided a polishing apparatus comprising a polishing table having a first axis, the polishing table being adapted to be subjected to a circular orbital motion in which the first axis of the polishing table is rotated about an orbit center axis while the orientation of the polishing table is kept substantially constant, a cylindrical support member having a center axis and provided around the polishing table, and a stationary bearing provided around the cylindrical member so as to allow the cylindrical support member to rotate about the center axis in response to the circular orbital motion of the polishing table. In this apparatus, due to the stationary bearing constructed as stated above, it will become possible to support the polishing table in a stable condition.

The above and other objects, features and advantages of the present invention will become more apparent from the following description of the preferred embodiments thereof, taken in conjunction with the accompanying drawings.

DETAILED DESCRIPTION OF THE INVENTION

Hereinbelow, embodiments of the present invention are explained, with reference to the drawings.

Figure 1:
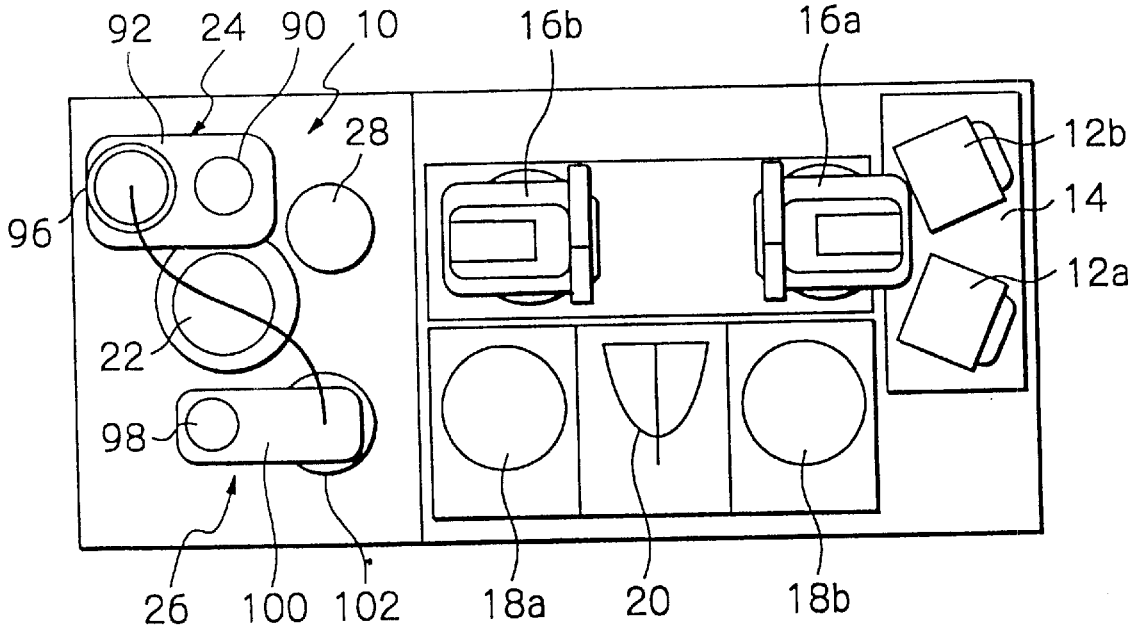
FIG. 1 is a general plan view of a polishing apparatus according to a first embodiment of the present invention.

FIGS. 1 to 6 show a polishing apparatus according to a first embodiment of the present invention. As shown in FIG. 1, the polishing apparatus as a whole has a rectangular bottom provided on the floor. The polishing apparatus comprises a polishing machine 10 provided on one side thereof and a loading/unloading unit 14 provided on the other side thereof. Substrate cassettes 12*a* and 12*b* are placed on the loading/unloading unit 14. Two transfer robots, namely, a first transfer robot 16*a* and a second transfer robot 16*b,* and two cleaning machines 18*a* and 18*b* are provided so as to face each other. A turning-over machine 20 is provided between the cleaning machines 18*a* and 18*b*.

The polishing machine 10 comprises a polishing table 22. A substrate holder machine 24 and a dressing machine 26 are provided on opposite sides of the polishing table 22. A lift 28 for loading and unloading substrates relative to the transfer robot 16*b* is provided at a side of the polishing table 22.

Figure 2:
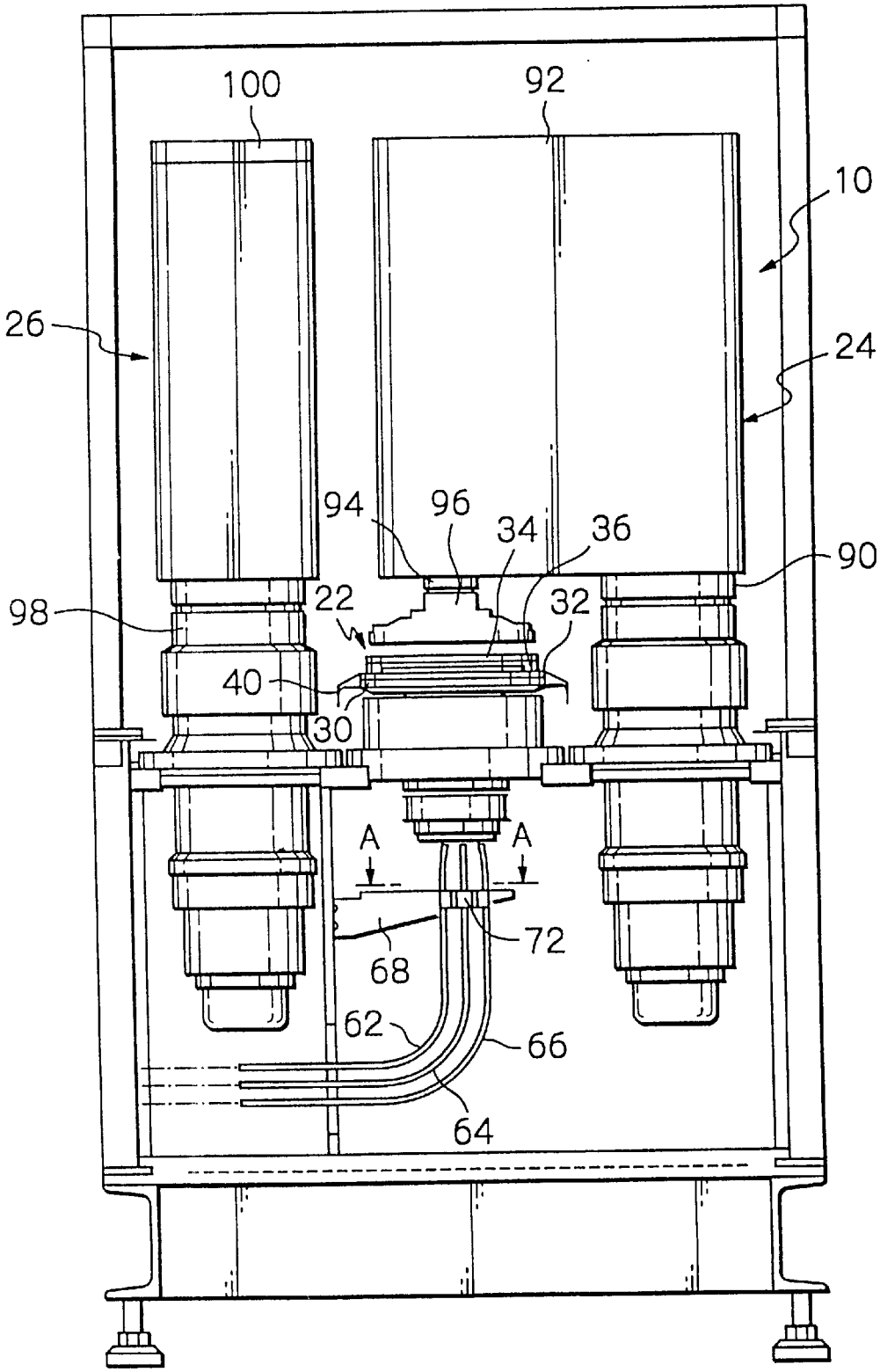
FIG. 2 is a front view of a polishing apparatus shown in FIG. 1.
Figure 3:
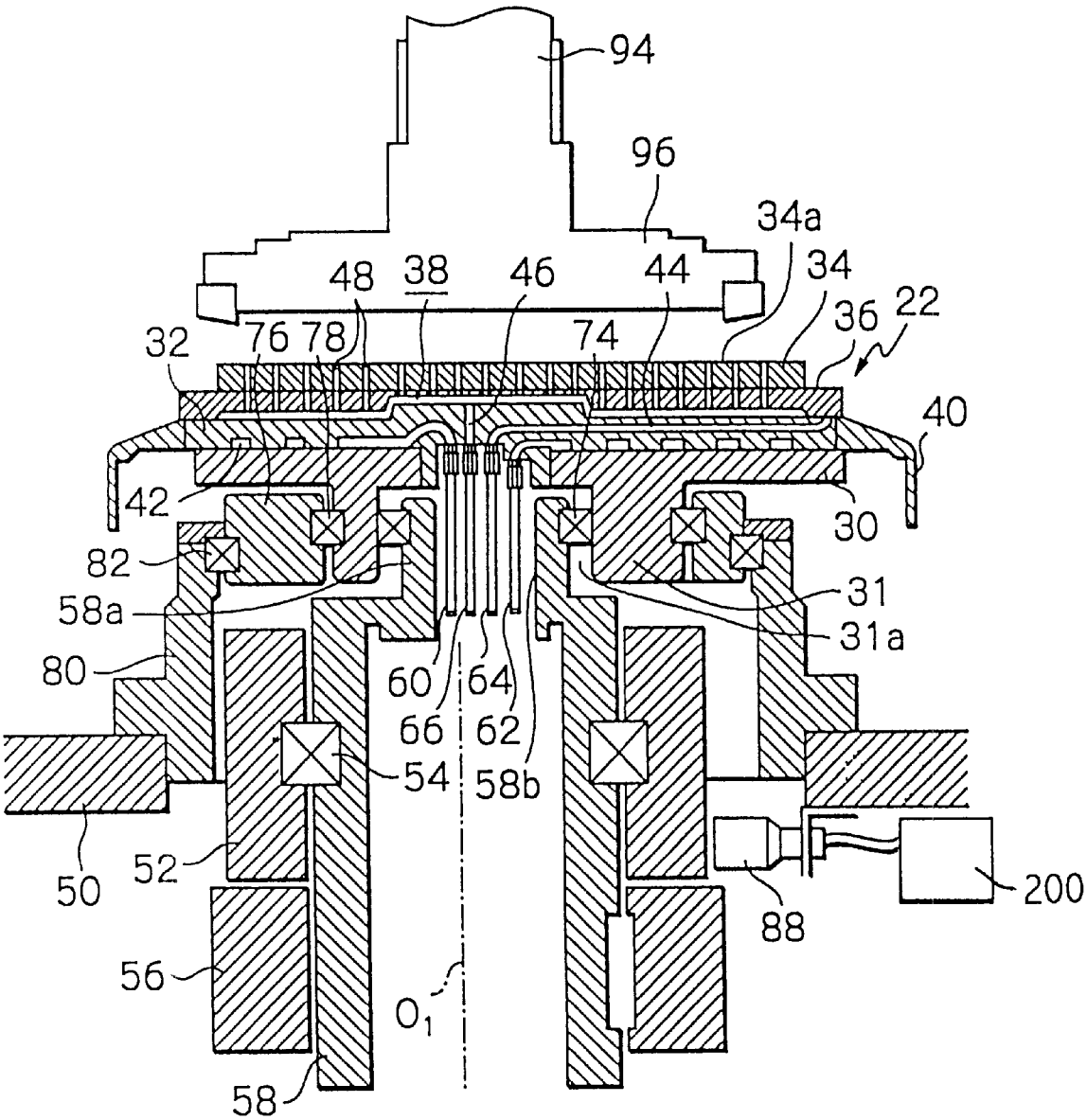
FIG. 3 is an enlarged cross-sectional view of a drive mechanism of FIG. 2.

As shown in FIGS. 2 and 3, the polishing table 22 comprises a generally circular mount 30 in a platy form, a first disk 32 connected to an upper surface of the mount 30, a second disk 36 connected to an upper surface of the first disk 32, and an abrasive plate 34 as a polishing member adhered to an upper surface of the second disk 36. The mount 30, the first disk 32, the second disk 36 and the abrasive plate 34 are positioned in a coaxial relationship. Respective connecting surfaces of the first disk 32 and the second disk 36 are formed so that a hermetic space 38 is formed when they are connected. A guide plate 40 is attached to the periphery of the first disk 32 so as to prevent entry of an abrasive liquid into a support mechanism. It should be noted that a polishing cloth may be used as the polishing member, instead of the abrasive plate.

A whirl-like groove is formed on a lower surface of the first disk 32, to thereby provide a temperature-controlling fluid passage 42 between the mount 30 and the first disk 32. A vacuum passage 44 is formed within the first disk 32 so as to extend radially outward and open at the periphery of the first disk 32 at a position where the first disk 32 abuts against the second disk 36. The vacuum passage 44 is connected to a vacuum machine, to thereby hold the second disk 36 on the first disk 32 under the influence of a vacuum. Further, an abrasive liquid passage 46 is formed at a central portion of the first disk 32 so as to extend upward and open to the space 38. Abrasive liquid discharge openings 48 vertically extend through the second disk 36 and the abrasive plate 34 so as to permit communication between the space 38 and an upper surface of the abrasive plate 34.

The polishing table 22 is supported by the support mechanism including a cylindrical housing 80 fixed to a base 50. The polishing table 22 is adapted to be subjected to a circular orbital motion by means of a drive mechanism provided at a lower position within the housing 80.

Figure 5:
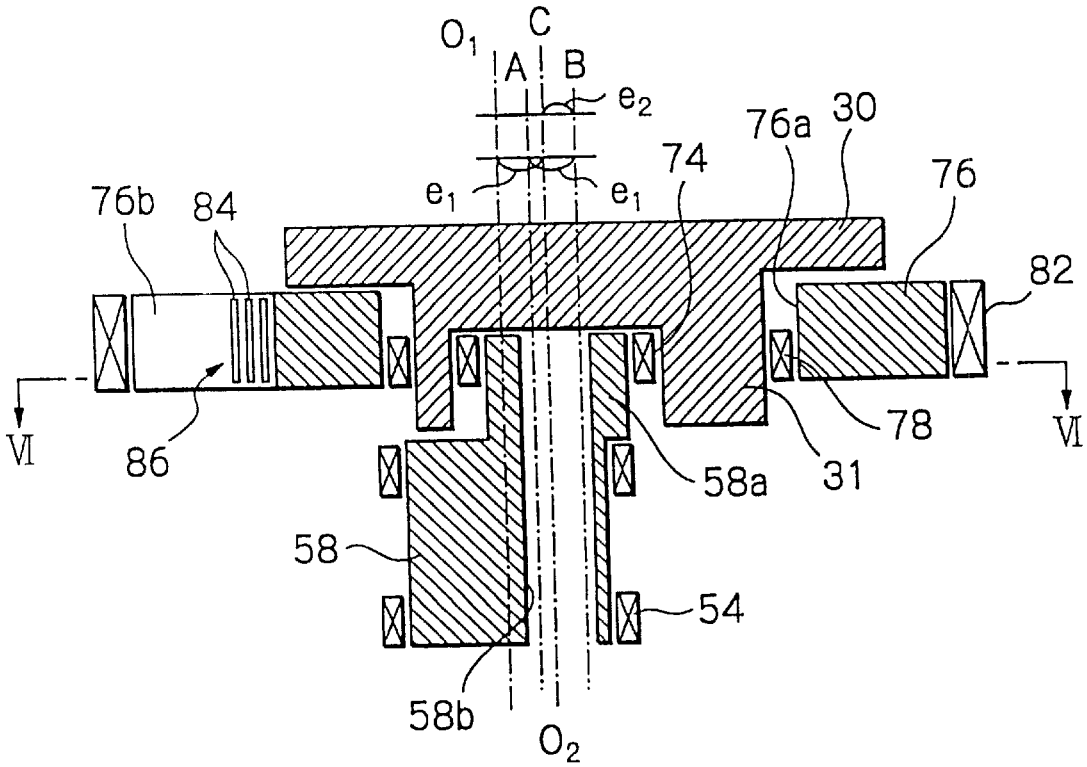
FIG. 5 is a cross-sectional view showing a mount providing a polishing table, together with a drive shaft.

Hereinbelow, the support mechanism is explained. A counterweight 76 in the form of a circular plate is rotatably connected to an upper end of the housing 80 through a bearing 82 for carrying axial and radial loads, so as to cover an upper end opening of the housing 80. Referring to FIG. 5, the counterweight 76 has a center axis A and a cylindrical opening 76*a* having a center axis B spaced apart from the center axis A by a distance e1. On the other hand, the mount 30 of the polishing table 22 has a cylindrical portion (connecting portion) 31 having a center axis coincident with the center axis B of the cylindrical opening 76*a,* which cylindrical portion projects downward from a central portion of a back surface of the mount 30 in a coaxial relationship. The cylindrical portion 31 is provided with a cylindrical recess 31*a* having a center axis C spaced apart from the center axis B by a distance e2. The cylindrical portion 31 is rotatably received in the cylindrical opening 76*a* of the counterweight 76 through a bearing 78 for carrying axial and radial loads. Thus, the mount 30 is supported by the housing 80 through the bearing 78, the counterweight 76 and the bearing 82.

Figure 6:
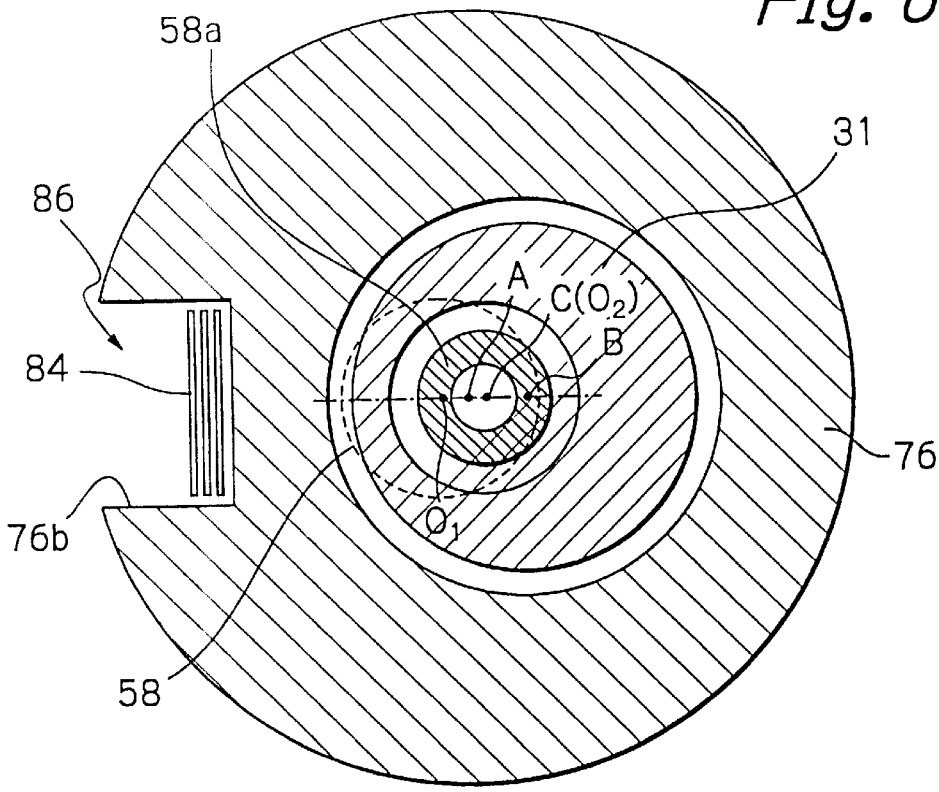
FIG. 6 is a plan view of FIG. 5.

As shown in FIG. 3, the drive mechanism comprises a drive shaft 58 which is rotatably supported by a fixed sleeve 52 through a bearing 54. The drive shaft 58 is adapted to be rotated through a pulley 56 and a belt (not shown) in accordance with operation of a drive motor (not shown). The drive shaft 58 has a cylindrical projection (connecting portion) 58*a* on an upper end thereof. As shown in FIGS. 5 and 6, the cylindrical projection 58*a* has a center axis O2 parallel with and spaced apart from a center axis O1 of the drive shaft 58. The distance between the center axis O2 and the center axis O1 is equal to the distance e1. The cylindrical projection 58*a* is rotatably received in the cylindrical recess 31*a* of the cylindrical portion 31 of the mount 30 through a bearing 74. Therefore, the center axis O2 coincides with the center axis C.

By this arrangement, when the drive shaft 58 rotates, the mount 30 is subjected to a circular orbital motion in which the center axis C of the cylindrical recess 31*a* of the cylindrical portion 31 of the mount 30 is rotated about the center axis O1 of the drive shaft 58 while maintaining the distance e1 therebetween. Due to this motion of the mount 30, the counterweight 76 rotates about its center axis A. In this embodiment, the center axis of the cylindrical portion 31 of the mount 30 (coincident with the center axis B of the cylindrical opening 76*a* of the counterweight 76) is spaced apart from the center axis A of the counterweight 76 and the center axis O2 of the cylindrical projection 58*a* is spaced apart from the center axis of the cylindrical portion 31 of the mount 30 (coincident with the center axis B of the cylindrical opening 76*a* of the counterweight 76). Therefore, it is possible to avoid dragging between the mount 30 and the counterweight 76 due to friction generated therebetween. That is, the orientation of the mount 30 (hence the polishing table 22) can be kept substantially constant during movement thereof.

Figure 4:
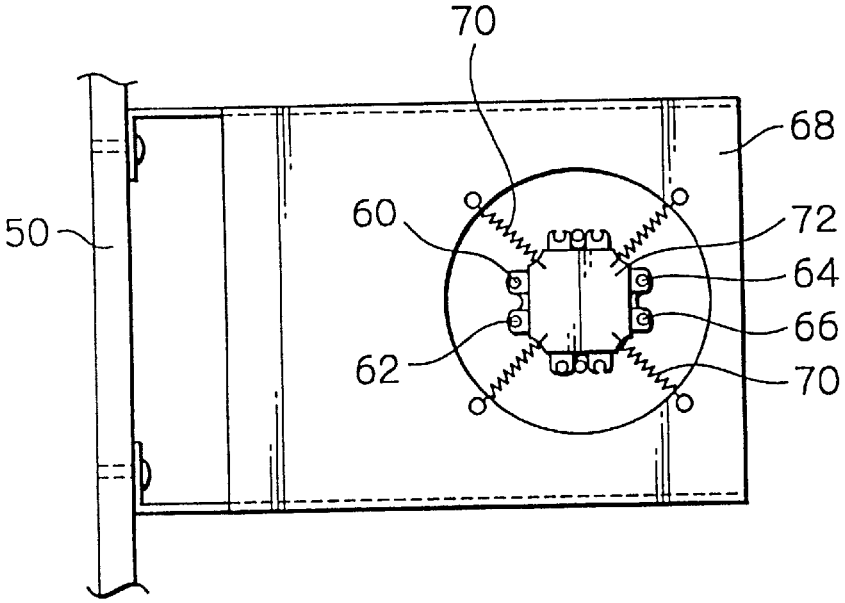
FIG. 4 is a cross-sectional view, taken along the line A—A in FIG. 2.

The drive shaft 58 includes a through-hole 58*b* formed therein. A temperature-controlling fluid inlet pipe 60 and a temperature-controlling fluid outlet pipe 62 connected to an inlet and an outlet of the temperature-controlling fluid passage 42, a vacuum pipe 64 connected to the vacuum passage 44 and an abrasive liquid supply pipe 66 connected to the abrasive liquid passage 46 extend through the through-hole 58*b*. Each of these pipes 60, 62, 64 and 66 is made of flexible material so as to be bendable. As shown in FIGS. 2 and 4, the pipes 60, 62, 64 and 66 extend downward and are supported by a bundling plate 72 which is movably connected through coil springs 70 to a bracket 68 fixed to the base 50. The polishing table 22 including the mount 30 does not rotate about the center axis thereof, so that it is unnecessary to use rotary joints for these pipes.

The counterweight 76 is designed in a manner such that it is subjected to substantially the same centrifugal force as that acting on the polishing table 22 including the first disk 32, the second disk 36 and the abrasive plate 34. As mentioned above, the counterweight 76 has the cylindrical opening 76*a*. A cut portion 76*b* is formed at the periphery of the counterweight 76 on a side opposite to the cylindrical opening 76*a* relative to the center axis A of the counterweight 76. The cylindrical opening 76*a* has an area larger than that of the cut portion 76*b*, so that a center G of gravity of the counterweight 76 is displaced from the center axis O1 (of the drive shaft 58) on a side opposite to the cylindrical opening 76*a*.

The position of the center G of gravity of the counterweight 76 is determined in a manner such that, when rotational motions of the counterweight 76 and the polishing table 22 are caused by means of the drive shaft 58, the centrifugal force caused in connection with the counterweight 76 balances the centrifugal force caused in connection with the polishing table 22. A weight member mounting portion 86 is provided at the cut portion 76*b* so that flat, platy weight members 84 can be removably mounted in the cut portion 76*b*. The weight of the counterweight 76 can be adjusted by adjusting the number of weight members 84 on the counterweight 76 so as to enable the above-mentioned balance between the centrifugal forces.

When the drive shaft 58 is rotated, the cylindrical projection 58*a* moves along a circle having a radius coincident with the distance e1, and the polishing table 22 is subjected to a circular orbital motion in which the center axis C is rotated about the center axis O1 while maintaining the distance e1 therebetween. In this instance, the counterweight 76 rotates in response to rotation of the polishing table 22 and cancels the centrifugal force generated by rotation of the polishing table 22. Therefore, vibration caused by run-out of the drive shaft due to the centrifugal force can be avoided. Further, the point of action of the centrifugal force on the counterweight 76 substantially coincides with that on the polishing table 22 in an axial direction, so that it is possible to minimize a bending moment which causes, deflection of the drive shaft, such as is generated in the conventional technique in which at least two counterweights are provided at different axial positions. Further, there is no need to attach a plurality of counterweights to the drive shaft 58 at different axial positions, so that the drive shaft 58 is not required to have a substantial length, leading to a reduction in size of the apparatus.

It is most preferred that the axial position of the center of gravity of the polishing table 22 coincide with that of the counterweight 76. However, this requirement is difficult to satisfy in a normal arrangement of the polishing table 22. The present inventor has conducted an experiment and found that vibration can be satisfactorily prevented when the distance between the center of gravity of the polishing table 22 and the center of gravity of the counterweight 76 is 30 mm or less as measured in an axial direction.

As shown in FIG. 3, a vibration meter 88 is attached to the base 50. The vibration meter 88 monitors vibration generated due to the circular orbital motion of the polishing table 22 and the rotation of the counterweight 76. An output terminal of the vibration meter 88 is connected to a controller 200 of the polishing apparatus. When the magnitude of vibration exceeds a certain level, the controller 200 outputs an alarm signal, to thereby stop rotation of the drive shaft 58. As the vibration meter 88, a displacement gauge can be used. However, an accelerometer may be attached to the fixed sleeve 52 or a stationary housing.

As shown in FIGS. 1 and 2, the substrate holder machine 24 comprises a substrate holder head 92 pivotally attached to an upper end of a support column 90, and a substrate holder shaft 94 supported on a free end of the substrate holder head 92 so as to be rotatable and vertically movable. A generally disk-like substrate holder 96 is attached to a lower end of the substrate holder shaft 94 so as to hold a substrate on a lower side thereof. The substrate holder head 92 contains therein a motor and a vertical piston/cylinder-type actuator (not shown) for driving the substrate holder 96. The substrate holder 96 is moved between a polishing position to bring a substrate into contact with the polishing table 22, a retracted position different from the polishing position and a loading/unloading position above the lift 28 by pivotally moving the substrate holder head 92 by means of an oscillation motor (not shown).

The dressing machine 26 comprises a dresser head 100 attached to an upper end of a support column 98 and a dresser shaft supported on a free end of the dresser head 100 so as to be rotatable and vertically movable. A dresser 102 having a dressing tool on a lower side thereof is attached to a lower end of the dresser shaft.

Next, operation of the polishing apparatus which is arranged as mentioned above is explained.

First, a substrate is removed from the cassette 12*a* or 12*b* by means of the first transfer robot 16*a* and transferred to the turning-over machine 20. The substrate is turned over by the turning-over machine 20 and transferred onto the lift 28 by means of the second transfer robot 16*b*. The substrate holder head 92 of the substrate holder machine 24 is pivotally moved, to thereby move the substrate holder 96 to a position above the lift 28. The lift 28 is moved upward and the substrate holder 96 holds the substrate under the influence of a vacuum. Subsequently, the substrate holder head 92 of the substrate holder machine 24 is pivotally moved, to thereby move the substrate holder 96 to a position above a polishing surface 34a of the polishing table 22.

The substrate holder 96 is lowered while being rotated, and is pressed against the polishing surface 34*a* of the polishing table 22 which is subjected to a circular orbital motion caused by rotation of the drive shaft 58. At the same time, a polishing liquid is supplied from the polishing liquid supply pipe 66 through the polishing liquid passage 46 and the abrasive liquid discharge openings 48 onto the polishing surface 34*a,* to thereby polish the substrate. Further, a temperature-controlling liquid is introduced into the temperature-controlling fluid passage 42, to thereby control the temperature of the polishing liquid which temporarily remains on the polishing table 22 or in the space 38.

After polishing, the substrate holder 96 is moved upward, to thereby separate the substrate from the polishing surface 34*a.* The substrate holder head 92 of the substrate holder machine 24 is pivotally moved, to thereby move the substrate holder 96 to the position above the lift 28. For separating the substrate from the polishing surface 34*a,* a fluid may be ejected under a pressure of, for example, 2 $kgf/cm^2$ or less from the abrasive liquid passage 46 or a passage other than the abrasive liquid passage 46 toward the substrate. Due to the force of the ejected fluid, the substrate is lifted against a surface tension between the substrate and the polishing surface 34*a,* to thereby ensure separation of the substrate from the polishing surface 34*a.* Further, when polishing is not conducted, pure water, an abrasive liquid or a chemical may be intermittently supplied from, for example, the abrasive liquid passage 46 through the abrasive liquid discharge opening 48 onto the polishing surface 34*a* so that the polishing surface 34*a* is prevented from becoming dry.

Next, the dresser head 100 of the dressing machine 26 which has been positioned at its retracted position is pivotally moved, to thereby move the dresser 102 to a position above the polishing surface 34*a*. The dresser 102 is lowered while being rotated at a relatively low speed, and is pressed against the polishing surface 34*a* of the polishing table 22 which is subjected to the circular orbital motion caused by rotation of the drive shaft 58. Thus, the polishing surface 34*a* is subjected to dressing by the dresser 102 and regenerated or conditioned. After dressing of the polishing surface 34*a,* the dresser 102 is lifted and the dresser head 100 of the dressing machine 26 is pivotally moved to the retracted position. The dresser 102 is adapted to be cleaned at the retracted position.

During dressing, the polished substrate is transferred from the substrate holder 96 to the lift 28. The substrate and the substrate holder 96 are cleaned with pure water or a cleaning liquid and the substrate holder head 92 of the substrate holder machine 24 is returned to the retracted position. Subsequently, the polished substrate on the lift 28 is transferred to the first cleaning machine 18*a* by means of the second transfer robot 16*b*. As the first cleaning machine 18*a,* for example, use is made of a cleaning machine which is capable of cleaning opposite surfaces of the substrate by using a roll sponge. After cleaning by the first cleaning machine 18*a,* the second transfer robot 16*b* transfers the substrate to the turning-over machine 20, where the substrate is turned over.

Thereafter, the substrate is removed from the turning-over machine 20 by the first transfer robot 16*a* and transferred to the second cleaning machine 18*b*. As the second cleaning machine 18*b,* for example, use is made of a cleaning machine which has a pen-type sponge for cleaning an upper surface of a substrate and has a spin-dry function. The substrate is cleaned and dried by the second cleaning machine 18*b* and returned to the cassette 12*a* or 12*b* by the first transfer robot 16*a*.

When the abrasive plate 34 is worn as a result of polishing, the number of weight members 84 mounted on the weight member mounting portion 86 of the counterweight 76 may be reduced as desired, to thereby adjust the weight of the counterweight 76. When the amount of wear of the abrasive plate 34 becomes undesirably large, application of a negative pressure in the vacuum passage 44 is stopped, to thereby remove the second disk 36 from the upper surface of the first disk 32. A new abrasive plate adhered to a mount is placed on the first disk 32 and a vacuum is produced in the vacuum passage 44, to thereby hold the mount with the abrasive plate onto the first disk 32.

Figure 7:
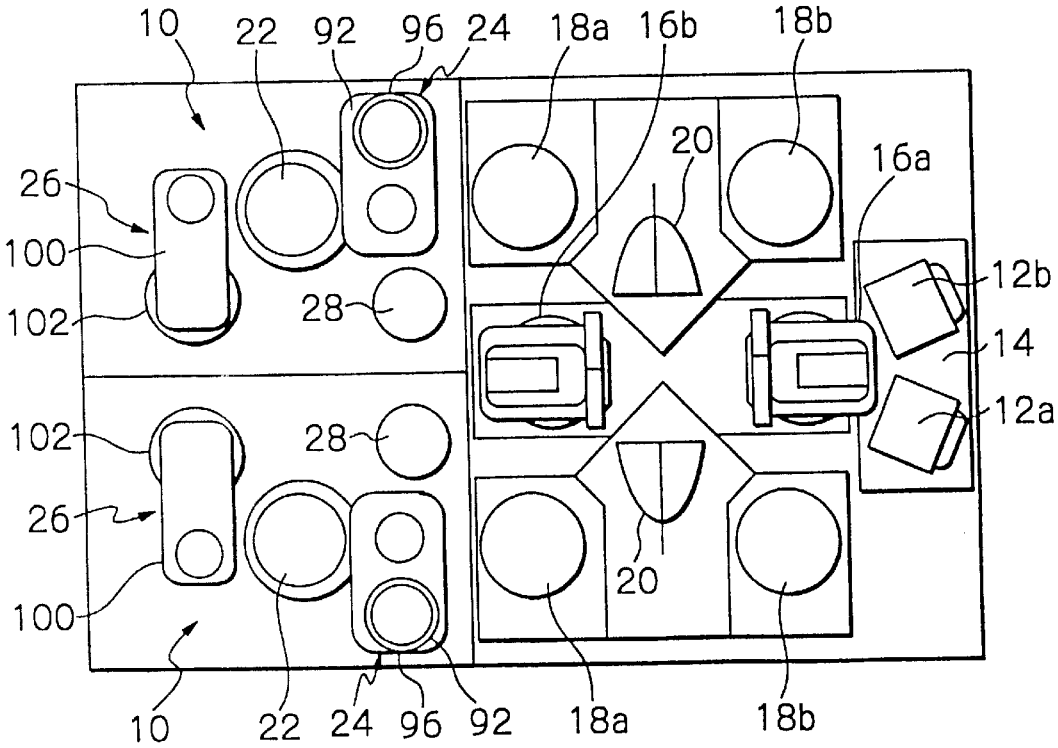
FIG. 7 is a general plan view of a polishing apparatus according to a second embodiment of the present invention.

FIG. 7 shows a second embodiment of the present invention. The polishing apparatus in this embodiment comprises two polishing machines 10, each being provided with two cleaning machines 18*a* and 18*b* and a single turning-over machine 20. Two transfer robots 16*a* and 16*b* are provided between the two polishing machines, so that a polishing operation and a dressing operation can be conducted in parallel.

In this embodiment, the transfer robots 16*a* and 16*b* are common to the two polishing machines, leading to a reduction in number of the transfer robots and a reduction in space for installation. By this arrangement, the polishing apparatus can be made compact as compared to providing two polishing apparatuses of the first embodiment in parallel.

Figure 8:
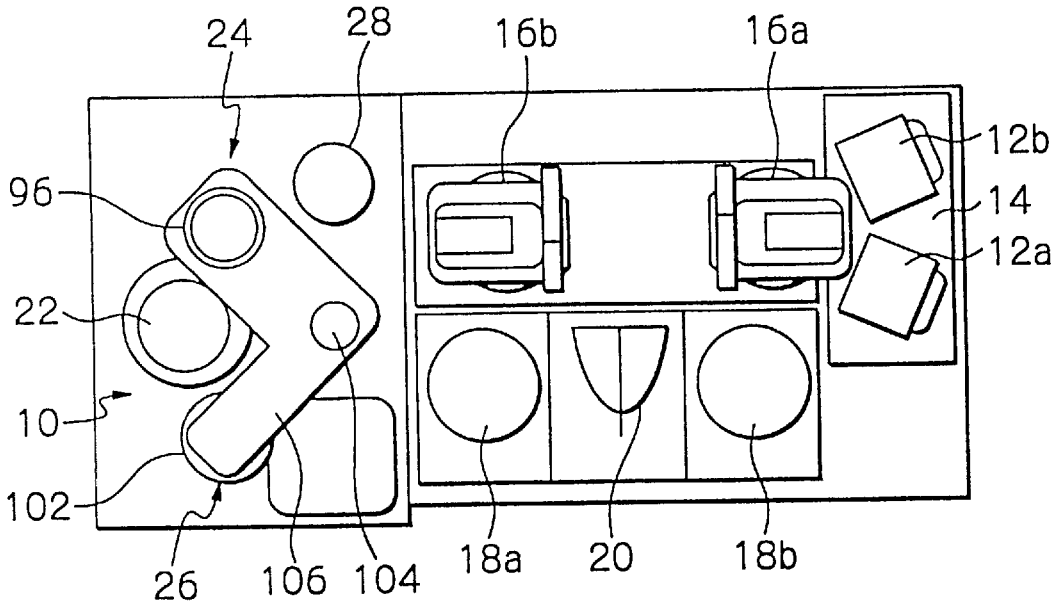
FIG. 8 is a general plan view of a polishing apparatus according to a third embodiment of the present invention.
Figure 9:
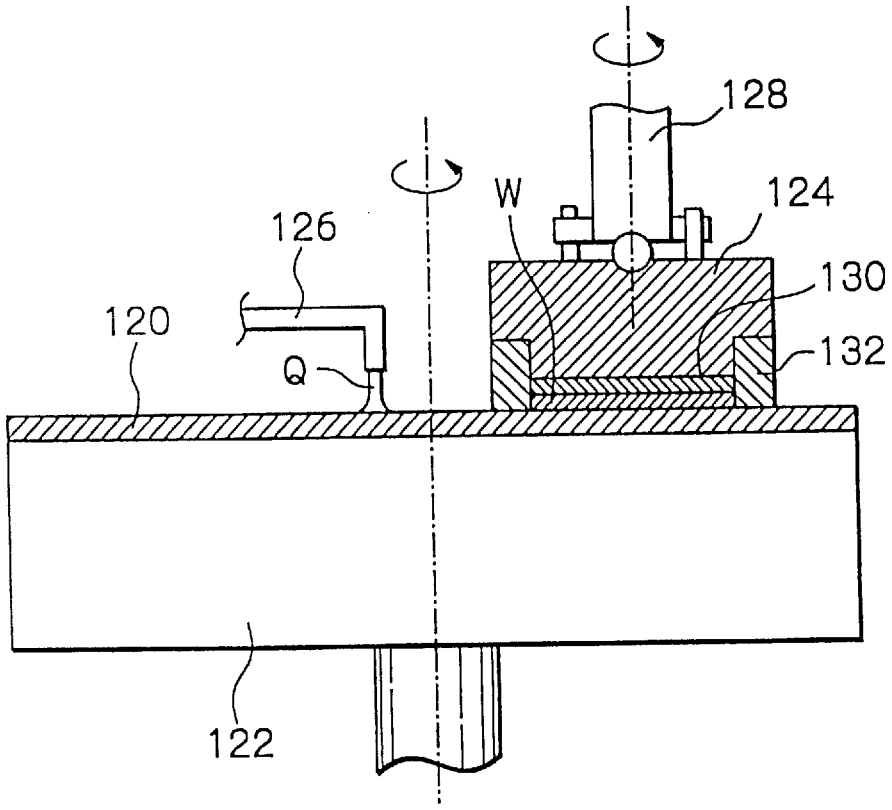
FIG. 9 is a cross-sectional view of a conventional polishing apparatus.

FIG. 8 shows a third embodiment of the present invention. In this embodiment, an oscillation head 106 in the form of a bell crank is provided at a side of the polishing table 22 so as to pivotally move in accordance with pivotal movement of a main shaft 104. The substrate holder 96 and the dresser 102 are supported on respective free ends of the oscillation head 106 so as to be rotatable and vertically movable. The substrate holder 96 and the dresser 102 can be moved as a unit between an operating position above the polishing table 22 and a retracted position, by pivotally moving the oscillation head 106.

It should be noted that the abrasive plate is used as the polishing surface in the above-mentioned embodiments. However, a polishing cloth having elasticity may be used, while an abrasive liquid is supplied onto the polishing surface as the polishing liquid.

As has been described above, in the present invention, the centrifugal force acting on the drive shaft (as a reaction force from the polishing table during a circular orbital motion thereof) is canceled by using a counterweight rotatably and stably supported by a support mechanism. Therefore, there is no need to attach a counterweight directly to the drive shaft and the drive shaft is not required to have a substantial length, leading to a reduction in size of the apparatus.

What is claimed is:

1. A polishing apparatus comprising:

a polishing table having a first axis, said polishing table being moveable in a circular orbital motion in which the first axis of said polishing table is rotated about an orbit center axis while an orientation of said polishing table is kept substantially constant;

a counterweight for cancellation of a centrifugal force generated by the circular orbital motion of said polishing table;

a stationary bearing for supporting said counterweight, said stationary bearing allowing said counterweight to rotate about a center axis of said counterweight in response to the circular orbital motion of said polishing table; and a drive shaft having a center axis, about which said drive shaft is rotated, and a cylindrical projection provided at one end of said drive shaft and having a center axis parallel with and spaced apart from a center axis of said drive shaft, wherein said polishing table has a cylindrical portion and said counterweight has a cylindrical opening to rotatably receive said cylindrical portion of said polishing table, the cylindrical opening of said counterweight has a center axis coinciding with a center axis of said cylindrical portion of said polishing table and spaced away from the center axis of said counterweight, and said cylindrical portion of said polishing table is provided with a cylindrical recess having a center axis coinciding with the center axis of said cylindrical projection of said drive shaft and the cylindrical recess rotatably receiving said cylindrical projection.

2. A polishing apparatus as set forth in claim 1, wherein the center axis of said drive shaft is parallel with and spaced apart from the center axis of said counterweight, the center axis of said cylindrical projection of said drive shaft is spaced apart from the center axis of said drive shaft by a distance larger than that between the center axis of said drive shaft and the center axis of said counterweight, and the center axis of said cylindrical portion of said polishing table is spaced apart from the center axis of said counterweight by the same distance as that between the center axis of said cylindrical projection of said drive shaft-and the center axis of said drive shaft.

3. A polishing apparatus comprising:

a polishing table having a first axis, said polishing table being moveable in a circular orbital motion in which the first axis of said polishing table is rotated about an orbit center axis while an orientation of said polishing table is kept substantially constant; and a counterweight for cancellation of a centrifugal force generated by the circular orbital motion of said polishing table, wherein said polishing table has a cylindrical portion and said counterweight has a cylindrical opening to rotatably receive said cylindrical portion of said polishing table, and said counterweight comprises one or more weight members removably mounted on said counterweight so that a weight of said counterweight is adjusted by adjusting a number of said one or more weight members on said counterweight.

4. A polishing apparatus comprising:

a polishing table having a first axis, said polishing table being moveable in a circular orbital motion in which the first axis of said polishing table is rotated about an orbit center axis while an orientation of said polishing table is kept substantially constant;

a counterweight for cancellation of a centrifugal force generated by the circular orbital motion of said polishing table;

a stationary bearing for supporting said counterweight, said stationary bearing allowing said counterweight to rotate about a center axis of said counterweight in response to the circular orbital motion of said polishing table; and a vibration meter being operable to sense vibration generated due to the circular orbital motion of said polishing table and a rotational motion of said counterweight, wherein said polishing table has a cylindrical portion and said counterweight has a cylindrical opening to rotatably receive said cylindrical portion of said polishing table, and the cylindrical opening of said counterweight has a center axis coinciding with a center axis of said cylindrical portion of said polishing table and spaced away from the center axis of said counterweight.

5. A polishing apparatus as set forth in claim 4, further comprising a controller being operable to generate an alarm signal when said vibration meter has sensed a magnitude of vibration exceeding a predetermined value.

6. A polishing apparatus comprising:

a polishing table having a first axis, said polishing table being moveable in a circular orbital motion in which the first axis of said polishing table is rotated about an orbit center axis while an orientation of said polishing table is kept substantially constant;

a cylindrical support member having a center axis and provided around said polishing table;

a housing provided around said cylindrical support member; and a stationary bearing provided between said cylindrical support member and said housing so as to allow said cylindrical support member to rotate about the center axis in response to the circular orbital motion of said polishing table, wherein said polishing table has a cylindrical portion having a center axis, and said cylindrical support member has a cylindrical opening to rotatably receive said cylindrical portion of said polishing table, the cylindrical opening having a center axis coinciding with the center axis of said cylindrical portion of said polishing table and spaced apart from the center axis of said cylindrical support member.

7. A polishing apparatus as set forth in claim 6, further comprising a drive shaft having a center axis, about which said drive shaft is rotated, and a cylindrical projection provided at one end of said drive shaft and having a center axis parallel with and spaced apart from the center axis of said drive shaft, wherein said cylindrical portion of said polishing table is provided with a cylindrical recess having a center axis coinciding with the center axis of said cylindrical projection of said drive shaft and the cylindrical recess rotatably receiving said cylindrical projection.

8. A polishing apparatus as set forth in claim 7, wherein the center axis of said drive shaft is parallel with and spaced apart from the center axis of said cylindrical support member, the center axis of said cylindrical projection is spaced apart from the center axis of said drive shaft by a distance larger than that between the center axis of said drive shaft and the center axis of said cylindrical support member, and the center axis of said cylindrical portion of said polishing table is spaced apart from the center axis of said cylindrical support member.

9. A polishing apparatus as set forth in claim 6, further comprising a vibration meter being operable to sense vibration generated due to the circular orbital motion of said polishing table and a rotational motion of said cylindrical support member.

10. A polishing apparatus as set forth in claim 6, further comprising a controller being operable to generate an alarm signal when said vibration meter has sensed a magnitude of vibration exceeding a predetermined value.

11. A polishing apparatus comprising:

a polishing table having a first axis, said polishing table being moveable in a circular orbital motion in which the first axis of said polishing table is rotated about an orbit center axis while an orientation of said polishing table is kept substantially constant;

a cylindrical support member having a center axis and provided around said polishing table;

a housing provided around said cylindrical support member; and a stationary bearing provided between said cylindrical support member and said housing so as to allow said cylindrical support member to rotate about the center axis in response to the circular orbital motion of said polishing table, wherein said cylindrical support member comprises one or more weight members removably mounted on said cylindrical support member so that a weight of said cylindrical support member is adjusted by adjusting a number of said one or more weight members on said cylindrical support member.

* * * * *